US009856586B2

(12) United States Patent
Shomura et al.

(10) Patent No.: US 9,856,586 B2
(45) Date of Patent: Jan. 2, 2018

(54) THREAD INSERTING DEVICE

(71) Applicant: Janome Sewing Machine Co., Ltd., Tokyo (JP)

(72) Inventors: Eiichi Shomura, Tokyo (JP); Ushio Yokoyama, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 29 days.

(21) Appl. No.: 15/244,164

(22) Filed: Aug. 23, 2016

(65) Prior Publication Data

US 2017/0081792 A1 Mar. 23, 2017

(30) Foreign Application Priority Data

Sep. 18, 2015 (JP) ..... 2015-185919

(51) Int. Cl.

| | |
|---|---|
| ***D03D 47/23*** | (2006.01) |
| ***D05B 53/00*** | (2006.01) |
| ***D05B 87/00*** | (2006.01) |
| ***D05B 63/00*** | (2006.01) |

(52) U.S. Cl.

CPC ..... *D03D 47/23* (2013.01); *D05B 53/00* (2013.01); *D05B 63/00* (2013.01); *D05B 87/00* (2013.01)

(58) Field of Classification Search

CPC .... D03D 47/23; D03D 47/233; D03D 47/236; D05B 53/00; D05B 87/00; D05B 87/02; D05B 87/04; D05B 57/00; D05B 63/00; D05B 91/00

See application file for complete search history.

(56) References Cited

U.S. PATENT DOCUMENTS

| | | | | | |
|---|---|---|---|---|---|
| 2,777,623 | A | * | 1/1957 | Balzer | D05B 87/00 223/99 |
| 2,800,262 | A | * | 7/1957 | Appel | D05B 7/00 112/225 |
| 4,649,843 | A | * | 3/1987 | Muroi | D05B 87/02 112/225 |
| 4,911,341 | A | * | 3/1990 | Davis | D05B 87/02 223/99 |
| 5,327,841 | A | * | 7/1994 | Sakuma | D05B 87/00 112/162 |
| 5,469,996 | A | * | 11/1995 | Hurlimann | D05B 87/00 112/225 |

(Continued)

FOREIGN PATENT DOCUMENTS

| | | |
|---|---|---|
| JP | H05-317560 A | 12/1993 |
| JP | H06-277383 A | 10/1994 |

*Primary Examiner* — Ismael Izaguirre

(74) *Attorney, Agent, or Firm* — Nakanishi IP Associates, LLC

(57) ABSTRACT

A thread inserting device includes a guide pin having a thread capture portion at its tip for capturing a thread; a holder that fixedly holds the guide pin; a main body (first and second main bodies) slidably mounting the holder; and a thread cutting portion provided to the main body for cutting the thread to a length equal to or smaller than the protrusion of the thread capture portion from a thread captured position on a thread tip 6*a* side after the thread is captured by the thread capture portion. By shifting the holder, the thread capture portion is protruded to a predetermined length from the main body, and the thread cut to a predetermined length by the thread cutting portion is inserted into the thread inserting hole.

6 Claims, 20 Drawing Sheets

(56) References Cited

U.S. PATENT DOCUMENTS

| | | | | |
|---|---|---|---|---|
| 6,830,165 | B2 * | 12/2004 | Tanaka | D05B 87/00 223/99 |
| 6,880,472 | B2 * | 4/2005 | Horiuchi | D05B 87/02 112/199 |
| 8,020,735 | B2 * | 9/2011 | Chang | D05B 87/02 223/99 |
| 8,733,262 | B2 * | 5/2014 | Noguchi | D05B 87/02 112/224 |
| 8,939,097 | B2 * | 1/2015 | Suzuki | D05B 63/00 112/199 |
| 2010/0126397 | A1 * | 5/2010 | Fujihara | D05B 87/02 112/225 |

* cited by examiner

THREAD INSERTING DEVICE

This application is based on and claims the benefit of priority to Japanese Patent Application No. 2015-185919 filed on Sep. 18, 2015, the contents of which are hereby incorporated by reference in their entirety.

TECHNICAL FIELD

The present invention relates to a thread inserting device.

BACKGROUND ART

An overlock sewing machine is provided with multiple loopers. There is a need to thread a different looper thread through each of the loopers, which requires a troublesome threading operation.

The invention of Japanese Patent H06-277383 discloses an apparatus configured to supply a thread using compressed air such that it reaches a looper blade tip having a hollow structure.

With such an air pressure threading apparatus using compressed air according to conventional techniques, there is a need to pinch a thread with the fingers so as to insert the thread into a thread inserting hole.

FIG. 20 is a diagram showing a step according to such conventional techniques in which a thread is inserted into such a thread inserting hole with the fingers.

With conventional techniques, for example, it is necessary to pinch a thread 6 with the fingers and carefully insert a thread tip 6*a* into an upper looper thread inserting hole 4 or otherwise a lower looper thread inserting hole 5.

SUMMARY OF INVENTION

However, in such a step in which a thread is inserted into the thread inserting hole with the fingers, it is difficult to confirm the thread insertion length with high precision (the manufacturer's recommended insertion length, for example, 2 to 3 cm). This leads to a problem in that, in a case in which the inserted thread length is insufficient, in some cases, such a threading operation is not performed normally. In order to solve such a problem, there is a need to measure the length of the pinched thread every time the threading operation is performed. However, such an operation is troublesome, which is undesirable.

Also, such an arrangement leads to a problem of large variation in the insertion length of such a thread thus inserted even in a case in which the thread is pinched so as to match a recommended length. Specifically, depending on the sensation of the operator, such an arrangement leads to a problem of the insertion length being excessively long or otherwise excessively short.

In the thread inserting operation, such an arrangement leads to another problem. That is to say, such a thread is not configured as a rigid thread. Accordingly, in a step in which such a thread is pinched and inserted into the thread insertion hole, in many cases, the thread readily changes its form. This can lead to a problem in that such a thread cannot be inserted in a straight line, and a problem in that such a thread becomes jammed on the inner wall of the thread inserting hole. In some cases, this leads to a problem in that such a thread cannot be inserted in an ideal state such that it reaches a predetermined depth of the thread inserting hole.

Furthermore, such an arrangement has a problem in that appropriate insertion cannot be visually confirmed after the thread is pinched with the fingers and inserted into the thread inserting hole. That is to say, the threading operation must be advanced without the ability to confirm whether or not the thread inserting operation has been performed appropriately. This leads to poor stability in such a threading operation, which is a problem.

It is a purpose of the present invention to provide a thread inserting device which is capable of inserting a thread of an appropriate length into a thread inserting hole in a simple and stable manner.

At least one embodiment of the present invention provides the following items to solve the above issue. It should be noted that, for ease of understanding, description will be made with reference to the reference symbols corresponding to an embodiment of the present invention. However, the present invention is not restricted to such an arrangement.

Embodiment (1)

One or more embodiments of the present invention disclosed to a thread inserting device (8, 8B) for inserting the thread (6) into a thread inserting hole (4, 5, 22) of a sewing machine. The thread inserting device (8, 8B) comprises: a guide member (13) having a thread capture portion (13*a*) at a tip end thereof configured to capture the thread (6); a holder (10) that fixedly holds the guide member (13); a main body (11, 12) slidably mounting the holder (10); and a thread cutting portion (21) that is provided to the main body (11, 12), and is configured to cut the thread (6) to a length that is equal to or otherwise smaller than a length of a protrusion of the thread capture portion (13*a*) from a position at which the thread (6) is captured by the thread capture portion (13*a*) on a thread tip (6*a*) side after the thread (6) is captured by the thread capture portion (13*a*). By shifting the holder (10), the thread capture portion (13*a*) is protruded to a predetermined length from the main body (11, 12), so as to insert the thread (6) cut to a predetermined length by the thread cutting portion (21) into the thread inserting hole (4, 5, 22).

Embodiment (2)

One or more embodiments of the present invention disclosed to a thread inserting device (8, 8B) for inserting a thread (6) into a thread inserting hole (4, 5, 22) of a sewing machine. The thread inserting device (8, 8B) comprises; a guide member (13) having a thread capture portion (13*a*) at a tip end thereof configured to capture the thread (6); a holder (10) that fixedly holds the guide member (13); a main body (11, 12) mounting the holder (10) and the guide member (13) such that they can be slidably shifted between an operating position at which the thread capture portion (13*a*) is protruded and a standby position at which the thread capture portion (13*a*) is retracted; a thread holding portion (16) that is provided to the main body (11, 12) and that is configured to hold the thread (6) on a thread reel side (6*b*) after the thread (6) is captured by the thread capture portion (13*a*) when the holder (10) is set to the standby position; and a thread cutting portion (21) that is provided to the main body (11, 12), and that is configured to cut the thread (6) to a length that is equal to or otherwise smaller than a length of a protrusion of the thread capture portion (13*a*) from a position at which the thread (6) is captured by the thread capture portion (13*a*) on a thread tip (6*a*) side after the thread (6) is captured by the thread capture portion (13*a*). By shifting the holder (10) to the operating position, the thread capture portion (13*a*) is protruded to a predetermined length from the main body (11, 12), so as to insert the thread (6) cut to a predetermined length by the thread cutting portion (21) into the thread inserting hole (4, 5, 22).

Embodiment (3)

One or more embodiments of the present invention disclosed to the thread inserting device (8, 8B) further comprises a releasing portion (17) that releases the thread (6) from being held by the thread holding portion (16), by shifting the holder from the standby position to the operating position side.

Embodiment (4)

One or more embodiments of the present invention disclosed to the main body (11, 12) comprises a first main body (11) and a second main body (12). The first main body (11) and the second main body (12) are arranged such that the guide member (13) is interposed between them. The holder (10) has a hole (10*b*) through which the main body (11, 12) and the guide member (13) are inserted. The main body (11, 12) is inserted together with the guide member (13) into the hole (10*b*) of the holder (10).

Embodiment (5)

One or more embodiments of the present invention disclosed to the thread inserting device (8, 8B) further comprises a force applying portion (14) that applies, to the holder (10), a force toward the standby position.

Embodiment (6)

One or more embodiments of the present invention disclosed to the main body (11, 12) comprises: a protruding portion (11*c*, 12*h*) configured to be inserted into the thread inserting hole (4, 5, 22) of the sewing machine; and a contact portion (E) that is provided as a periphery of the protruding portion (11*c*, 12*h*), and that comes in contact with a periphery of the thread inserting hole (4, 5, 22) so as to maintain a position of the main body (11, 12) when the holder (10) is shifted toward the operating position side against the force applied by the force applying portion (14).

With One or more embodiments of the present invention, a thread inserting device is provided, which allows a predetermined length of a thread to be inserted into a thread inserting hole in a simple and stable manner.

DETAILED DESCRIPTION

Description will be made below with reference to the drawings and the like regarding a best mode for carrying out the present invention.

First Embodiment

Figure 1:
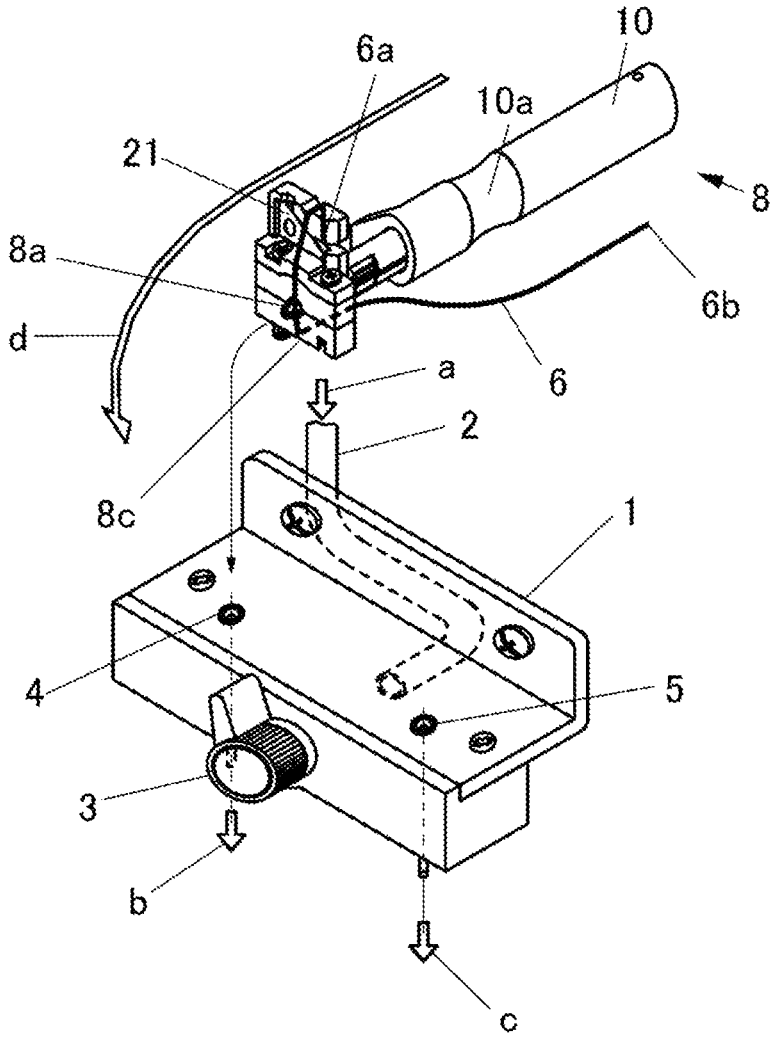
FIG. 1 is a diagram showing a thread inserting device 8 according to the present invention and a thread inserting unit 1 of an air pressure threading apparatus.

FIG. 1 is a diagram showing a thread inserting device 8 according to the present invention and a thread inserting unit 1 of an air pressure threading apparatus.

It should be noted that the drawings including FIG. 1 that will be referred to in the following description are each shown as a schematic diagram. That is to say, the size and the structure of each component are exaggerated as appropriate for ease of understanding.

Also, description will be made below with specific values, structures, materials, and the like, which may be changed as appropriate.

The thread inserting unit 1 is configured as a component of a sewing machine threading apparatus (the overall configuration of such a sewing machine and threading apparatus are not shown). The thread inserting unit 1 is configured as a unit that inserts an upper looper thread or otherwise a lower looper thread into the threading apparatus. The thread inserting unit 1 receives the supply of compressed air a via a tube 2. Using the air flow thus supplied, the thread inserting unit 1 transfers a corresponding thread to an upper looper blade tip (not shown) or otherwise a lower looper blade tip (not shown) via an upper looper thread discharging path b or otherwise a lower looper thread discharging path c.

A selection knob 3 is configured as an operating member for the purpose of switching the looper for which threading is to be performed, between the upper looper and the lower looper.

An upper looper thread inserting hole 4 and a lower looper thread inserting hole 5 are each configured as a thread inserting hole, i.e., an inlet into which a corresponding thread is to be inserted into the thread inserting unit 1 for the purpose of the threading operation. As described above, with conventional techniques, it is necessary to pinch with the fingers a thread 6 to be inserted, and to insert the thread 6 into the upper looper thread inserting hole 4 or otherwise the lower looper thread inserting hole 5. The thread 6 is set such that its thread reel side 6*b* extends to an unshown thread reel mounted on the sewing machine.

In a step in which the thread tip 6*a* is inserted into the upper looper thread inserting hole 4 or otherwise the lower looper thread inserting hole 5, in order to allow the thread 6 to be smoothly transferred to the upper looper blade tip or otherwise the lower looper blade tip by means of air flow supplied by the air pressure threading apparatus, there is a need to insert a predetermined length (e.g., 2 cm to 3 cm) of the thread 6 into the upper looper thread inserting hole 4 or otherwise the lower looper thread inserting hole 5.

The present embodiment proposes the thread inserting device 8 configured to insert the thread 6 with high stability in a sure manner. Description will be made below regarding such an arrangement.

The thread inserting device 8 is configured as a device according to an entirely new concept that has not been known in conventional techniques. Accordingly, first, an outline description will be made regarding a form of use of the thread inserting device 8.

The thread inserting device 8 according to the present embodiment is formed so as to be approximately rod-shaped in overall structure. In a state shown in FIG. 1, the thread 6 is stretched across a conical protrusion slit 8*a* of the thread inserting device 8. Furthermore, thread cutting is performed by means of a thread cutting blade 21 such that the thread tip 6*a* has a predetermined length. The thread 6 is set such that its thread reel side 6*b* is held by a back face 8*c* of the thread inserting device 8 and extends to a thread reel (not shown) mounted on the sewing machine (detailed description thereof will be made later).

After the thread 6 is held by the thread inserting device 8 as described above, a recess 10*a* formed in a holder 10 of the thread inserting device 8 is pinched with the fingers, and the position of the thread inserting device 8 is shifted in the direction indicated by the arrow d, for example, such that the conical protrusion slit 8*a* is positioned directly above and aligned with the upper looper thread inserting hole 4 or otherwise the lower looper thread inserting hole 5. Next, the holder 10 is lowered directly downward. As a result of this operation, a predetermined length (for example, a predetermined length on the order of 2 cm to 3 cm) of the thread 6 is inserted into the upper looper thread inserting hole 4 or otherwise the lower looper thread inserting hole 5 (detailed description thereof will be made later).

Next, more detailed description will be made regarding the configuration of the thread inserting device 8 according to the present embodiment.

Figure 2:
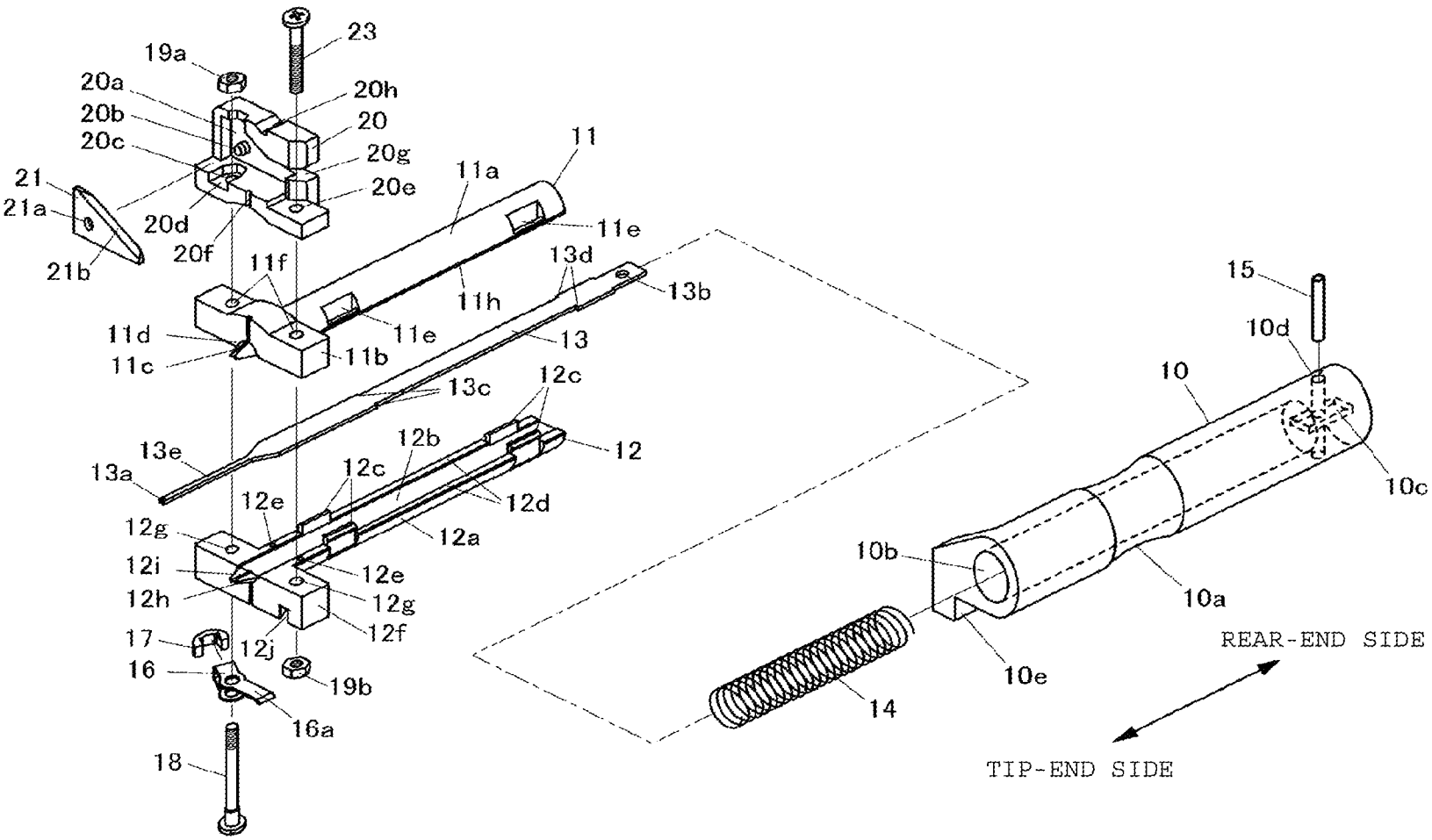
FIG. 2 is an exploded perspective view showing the thread inserting device 8 according to the present embodiment.

FIG. 2 is an exploded perspective view showing the thread inserting device 8 according to the present embodiment.

It should be noted that, for ease of understanding, description will be made below using an orientation as indicated by the arrows FIG. 2, i.e., "the tip-end side" and "the rear-end side". However, description using such terms that represent such an orientation is by no means intended to restrict a configuration according to the present invention.

The thread inserting device 8 includes the holder 10, a first main body 11, a second main body 12, a guide pin 13, a holder spring 14, a pin 15, a thread holding spring 16, a strike plate 17, a shoulder screw 18, nuts 19*a* and 19*b*, a thread cutting base 20, a thread cutting blade 21, and a screw 23.

The holder 10 is formed in an approximately cylindrical shape having a recess 10*a*, a cylindrical hole 10*b*, a slit 10*c*, a round through hole 10*d*, and a tip-end protrusion 10*e*. The holder 10 is configured to fix and hold the guide pin 13.

The recess 10*a* is formed in the holder 10 at an approximately central position along its extending direction such that it has a diameter that is slightly smaller than those of both sides of the holder 10 between which the recess 10*a* is positioned. The recess 10*a* is provided in order to allow the user to easily pinch the thread inserting device 8 with the fingers, and to easily apply force to the holder 10.

The cylindrical hole (hole portion) 10*b* is configured as a cylindrical hole having a bottom. The first main body 11, the second main body 12, the guide pin 13, and the holder spring 14 are inserted into the cylindrical hole 10*b*.

The slit 10*c* is configured as a narrow-width slit in the bottom of the cylindrical hole 10*b*. The rear end of the guide pin 13 is inserted into the slit 10*c*.

The round through hole 10*d* is formed as a through hole in the holder 10 such that it passes through in a direction that is orthogonal to the holder 10 extending direction. The pin 15 is inserted into the round through hole 10*d*.

The tip-end protrusion 10*e* is formed on the tip-end side such that it protrudes toward the lateral side. The tip-end protrusion 10*e* is configured such that it can come in contact with the strike plate 17 as described later.

The first main body 11 comprises a main body portion 11*a*, a rectangular portion 11*b*, and a tip-end portion 11*c*.

The main body portion 11*a* is configured as a structure which can be obtained by dividing in half an approximately cylindrical structure. The main body portion 11*a* has rectangular openings 11*e* at four respective positions. Each rectangular opening 11*e* is configured as a through hole that penetrates from the outer face of the cylindrical structure to the center face that divides the cylindrical structure. Each rectangular opening 11*e* is fitted to a corresponding one of four hooks 12*c* provided to the second main body 12, thereby engaging the first main body 11 with the second main body 12 in a fixed manner.

A shallow groove 11*h* (see FIGS. 7 and 8) is formed in a face of the first main body 11 on the side to be combined with the second main body 12. By combining the first main body 11 and the second main body 12, such an arrangement provides a space defined by the groove 11*h* and a groove 12*b* formed in the second main body. Such an arrangement allows the guide pin 13 to be slid in the longitudinal direction in the space thus defined.

The rectangular portion 11*b* is provided on the tip-end side of the main body portion 11*a*, and is configured in an approximately rectangular shape. The rectangular portion 11*b* is provided with two round holes 11*f* respectively formed in the left side and the right side thereof. Each round hole 11*f* is configured as a through hole that penetrates through a direction that is orthogonal to the longitudinal direction.

The tip-end portion (protrusion) 11*c* is configured as a protruding structure which can be obtained by dividing in half a conical structure. The tip-end portion 11*c* is provided with a slit 11*d* formed at a central position. The slit 11*d* is formed such that it extends up to a side face (tip-end face) of the rectangular portion 11*b*.

The second main body 12 comprises a main body portion 12*a*, a rectangular portion 12*f*, and a tip-end portion 12*h*. That is to say, the second main body 12 has a configuration that is similar to that of the first main body 11.

The main body portion 12*a* is configured as a structure which can be obtained by dividing in half an approximately cylindrical structure. As described above, a shallow groove 12*b* is formed in the main body portion 12*a*. Furthermore, the main body portion 12*a* is provided with four hooks 12*c* formed such that they conform to the respective rectangular openings 11*e*. Two small holes are formed in a joint face 12*d* which is to be joined to the center face of the first main body 11 obtained by dividing the cylindrical structure. In a step in which the first main body 11 is combined with the second main body 12, the small holes 12*e* are fitted to small protrusions 11*g* formed in the first main body 11 (see FIG. 7), which provides an alignment function.

The rectangular portion 12*f* is provided on the tip-end side of the main body portion 12*a*, and is configured in an approximately rectangular shape. The rectangular portion 12*f* is provided with two round holes 12*g* respectively formed in the left side and the right side thereof in the same manner as in the first main body 11.

The tip-end portion (protrusion) 12*h* is configured as a protruding structure which can be obtained by dividing in half a conical structure. The tip-end portion 12*h* is provided with a slit 12*i* formed in the same manner as in the first main body 11. The slit 12*i* is formed such that it extends up to a side face (tip-end face) of the rectangular portion 12*f*.

The first main body 11 and the second main body 12 are arranged and combined such that the guide pin 13 is interposed between them. The main body is configured as a combination of the first main body 11 and the second main body 12. The holder 10 and the guide pin 13 are mounted on the main body (11, 12) such that they can be slid between an operating position at which a thread capture portion 13*a* (described later) is protruded from the main body (11, 12), and a standby position at which the thread capture portion 13*a* is retracted within the main body (11, 12).

In the present embodiment, the guide pin (guide member) 13 is formed in the form of a thin plate. The guide pin 13 is provided with a thread capture shaft portion 13*e* configured such that it extends in a long and narrow shape. At the tip-end portion of the thread capture shaft portion 13*e*, a thread capture portion 13*a* is provided in the form of a U-shaped recess, which allows the thread 6 to be captured. Furthermore, at the rear end of the guide pin 13, a round opening 13*b* is provided so as to allow the pin 15 to pass through. Furthermore, a stopper step portion 13*c* and a stopper step portion 13*d* are provided to an intermediate portion of the guide pin 13. The stopper step portion 13*c* functions as a stopper that defines the standby position of the first main body 11 and the second main body 12, and the stopper step portion 13*d* functions as a stopper that defines the operating position (thread extruding position) of the first main body 11 and the second main body 12.

A holder spring (force applying portion) 14 is inserted into the inner portion of the cylindrical hole 10*b* of the holder 10. The holder spring 14 applies a force at all times to the holder 10 and the guide pin 13 toward the rear-end side of the first main body 11 and the second main body 12, i.e., toward the standby position side.

The pin 15 is inserted into the round through hole 10*d* of the holder 10 and the round opening 13*b* of the guide pin 13, which fixes the guide pin 13 to the holder 10.

The thread holding spring (thread holding portion) 16 is fixed to a side face (lower-side face in FIG. 2) of the rectangular portion 12*f* of the second main body 12 using the shoulder screw 18 and the nut 19*a*, such that it can be turned. When the holder 10 is set to the standby position, the thread holding spring 16 holds the thread 6 on its thread reel side 6*b* after it is captured by the thread capture portion 13. That is to say, in a threading step, such an arrangement allows a thread reel side 6*b* (see FIG. 1) of the thread 6 to be held between an arm portion 16*a* of the thread holding spring 16 and the rectangular portion 12*f*. This prevents unintended feeding of the thread reel side 6*b* of the thread 6 to the upper looper thread inserting hole 4 or the lower looper thread inserting hole 5 of the thread inserting unit 1.

The strike plate (releasing portion) 17 is fixed to the thread holding spring 16 such that they engage with each other. When the holder 10 is pressed so as to perform a thread inserting operation, the holder 10 is shifted from the standby position to the operating position side. In this state, the tip-end protrusion 10*e* of the holder 10 presses the strike plate 17. This turns the strike plate 17, and accordingly, it turns the thread holding spring 16 with the shoulder screw 18 as the center of rotation. As a result of the step in which the thread holding spring 16 is turned, the thread reel side 6*b* (see FIG. 1) of the thread 6 is eventually released from being held by means of the arm portion 16*a*.

The thread cutting base 20 is configured as a base that fixedly mounts the thread cutting blade 21. The thread cutting base 20 is fixedly mounted on the rectangular portion 11*b*. The thread cutting base 20 includes a mounting portion 20*a* that mounts the thread cutting blade 21 and a fixing protrusion 20*b* that corresponds to a round opening 21*a* formed in the thread cutting blade 21. In the present embodiment, the fixing protrusion 20*b* is melted and flattened in a state in which the thread cutting blade 21 is mounted on the mounting portion 20*a*, so as to weld and fix the thread cutting blade 21 to the thread cutting base 20.

Furthermore, the side wall of the thread cutting base 20 is provided with a through hole 20*c* into which the shoulder screw 13 is to be inserted, and a recess 20*d* in which the nut 19*a* is to be housed. Furthermore, a through hole 20*e* is provided to the other end of the side wall so as to allow a screw 23 to be inserted, thereby fixing the thread cutting base 20 to the first main body 11 and the second main body 12. Moreover, the thread cutting base 20 has a thread groove 20*f* on the side wall of the tip-end side, in the form of an extension of the slit 11*d* formed in the first main body 11. The screw 23 is fixed by screwing using the nut 19*b* housed in a recess 12*j* formed in the second main body 12 on the opposite side of the screw 23. Furthermore, a guide groove 20*g* is formed at an approximately central portion of the thread cutting base 20 so as to guide a thread toward a blade portion 21*b* of the thread cutting blade 21. Moreover, a thread hook 20*h* on which a thread is hooked when the thread is to be set is provided to the thread cutting base 20 on its outer-side face (upper-side face in FIG. 2).

The thread cutting blade (thread cutting portion) 21 is provided with the blade portion 21*b* configured to cut the thread 6. The thread cutting blade 21 is fixed to the thread cutting base 20. In a state in which the thread 6 is captured by the thread capture portion 13*a*, such an arrangement allows the thread cutting blade 21 to cut the thread 6 to a predetermined length from the thread capture portion 13*a* on a thread tip 6*a* side that is opposite to the thread reel side 6*b*.

Figure 3:
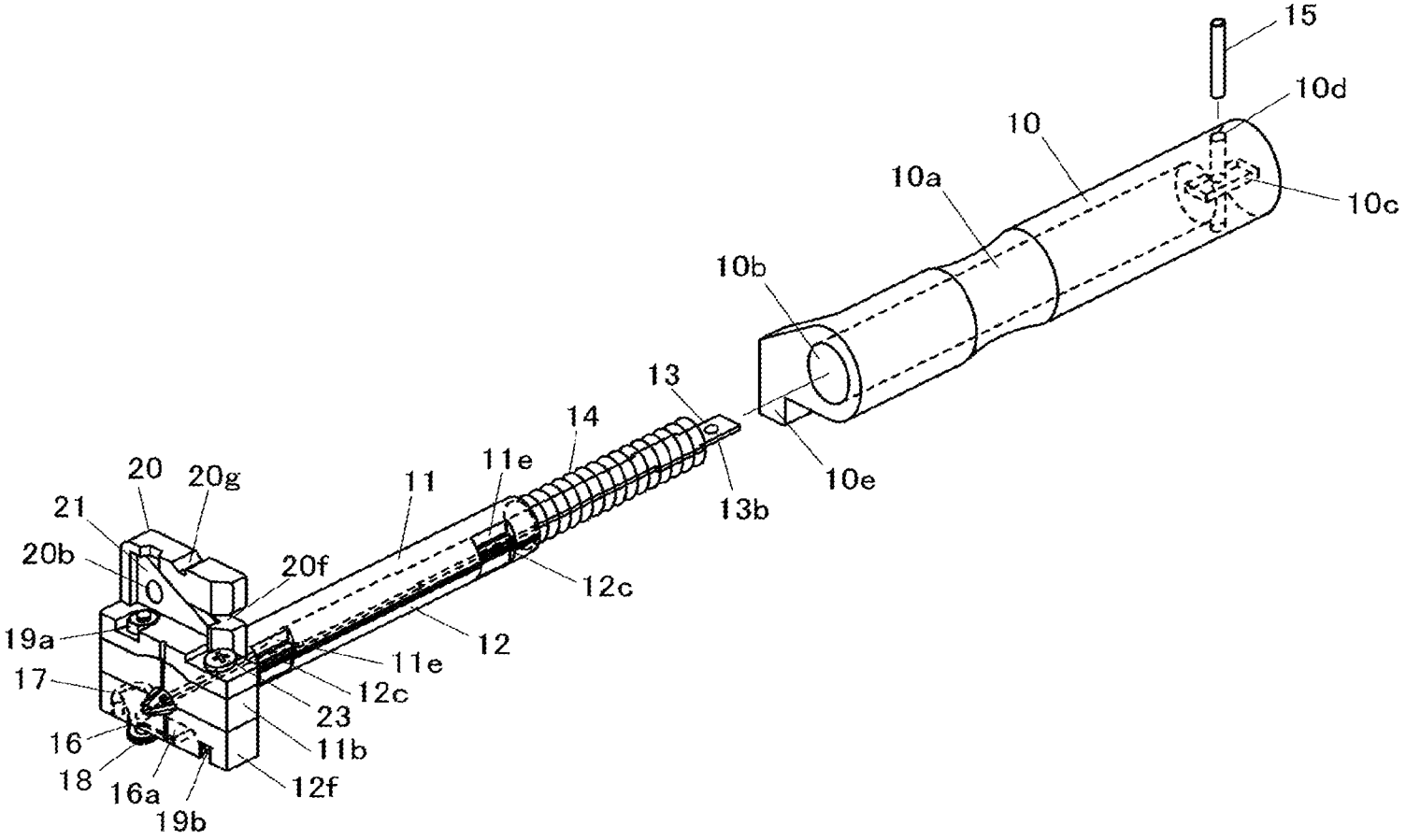
FIG. 3 is a diagram showing a state before the first main body 11 and the second main body 12 are inserted into the holder 10.

FIG. 3 is a diagram showing a state before the first main body 11 and the second main body 12 are inserted into the holder 10.

In such a state shown in FIG. 3, the guide pin 13 is slidably provided to a central space defined between the first main body 11 and the second main body 12. In this state, the four rectangular openings 11*e* are engaged with the respective hooks 12*c* so as to combine the first main body 11 and the second main body 12.

By screwing the shoulder screw 18 and the screw 23 into the nuts 19*a* and 19*b*, respectively, the rectangular portion 11*b* of the first main body 11 is fixed to the thread cutting base 20 to which the thread cutting blade 21 is welded and fixed. Furthermore, the thread holding spring 16 is mounted on the rectangular portion 12*f* of the second main body 12 by means of the shoulder screw 18 such that the thread holding spring 16 can be turned.

The rear-end side of the guide pin 13 is inserted into the holder spring 14. In this state, the rear-end side of the guide pin 13 is inserted together with the holder spring 14 into the cylindrical hole 10*b* formed in the holder 10. Furthermore, the rear end of the guide pin 13 is inserted into the slit 10*c* formed in the holder 10. The pin 15 is press-fitted in a state in which the round through hole 10*d* of the holder 10 matches the round opening 13*b* of the guide pin 13, thereby fixing the guide pin 13 to the holder 10.

Figure 4:
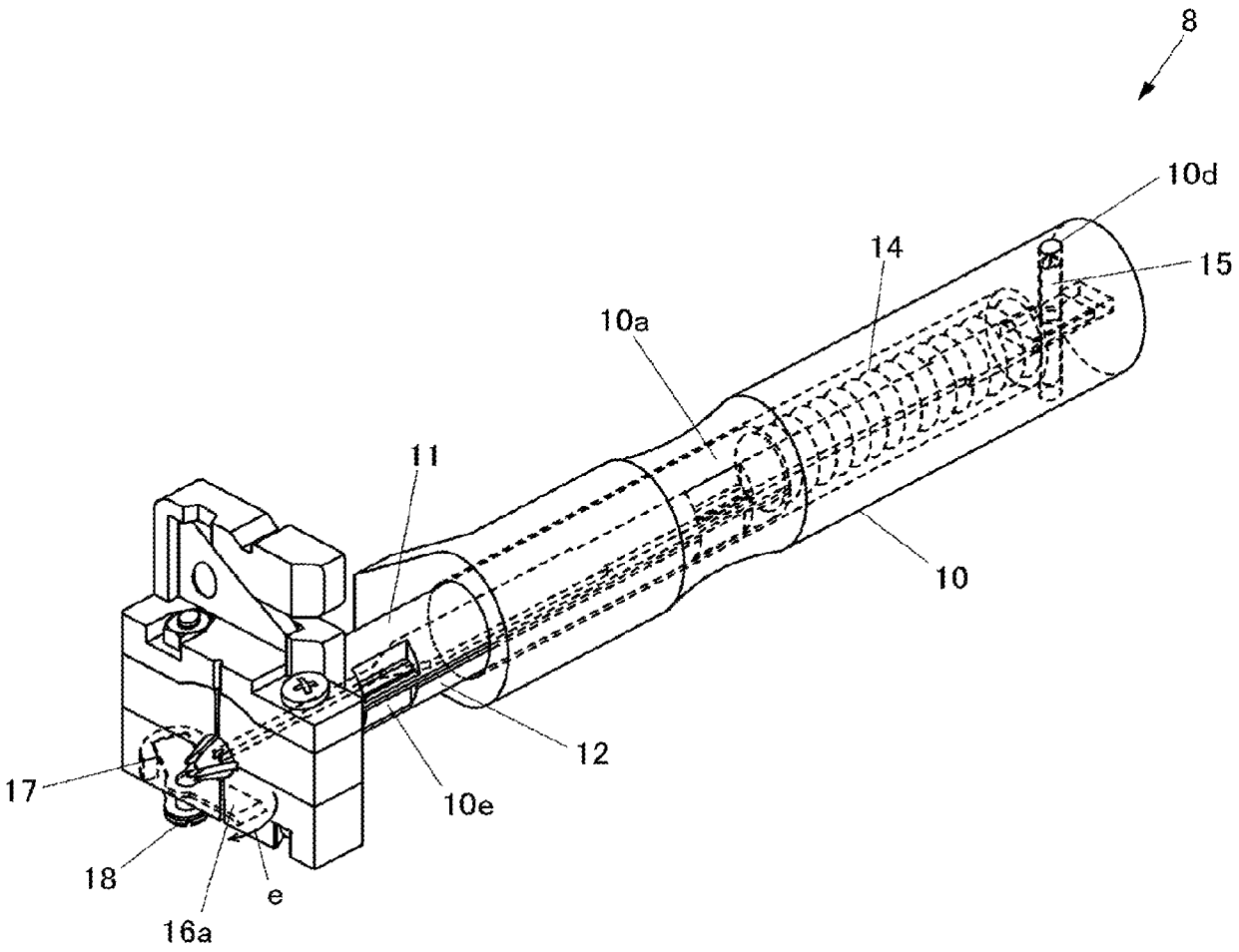
FIG. 4 is a diagram showing a completed state of the thread inserting device 8 after the pin 15 is used to assemble the members from the state shown in FIG. 3.

FIG. 4 is a diagram showing a completed state of the thread inserting device 8 after the pin 15 is used to assemble the members from the state shown in FIG. 3.

In such a state shown in FIG. 4, the holder spring 14 applies a force to the holder 10 toward the rear-end side, thereby holding the holder 10 at the standby position. Accordingly, the whole of the guide pin 13 fixed to the holder 10 is retracted and housed in the inner space defined by the first main body 11 and the second main body, i.e., in the inner space of the holder 10.

When the holder 10 and the guide pin 13 are set to the standby position as shown in FIG. 4, the arm portion 16*a* of the thread holding spring 16 is turned in the arrow e direction as shown in FIG. 4, which allows a thread to be held.

Figure 5:
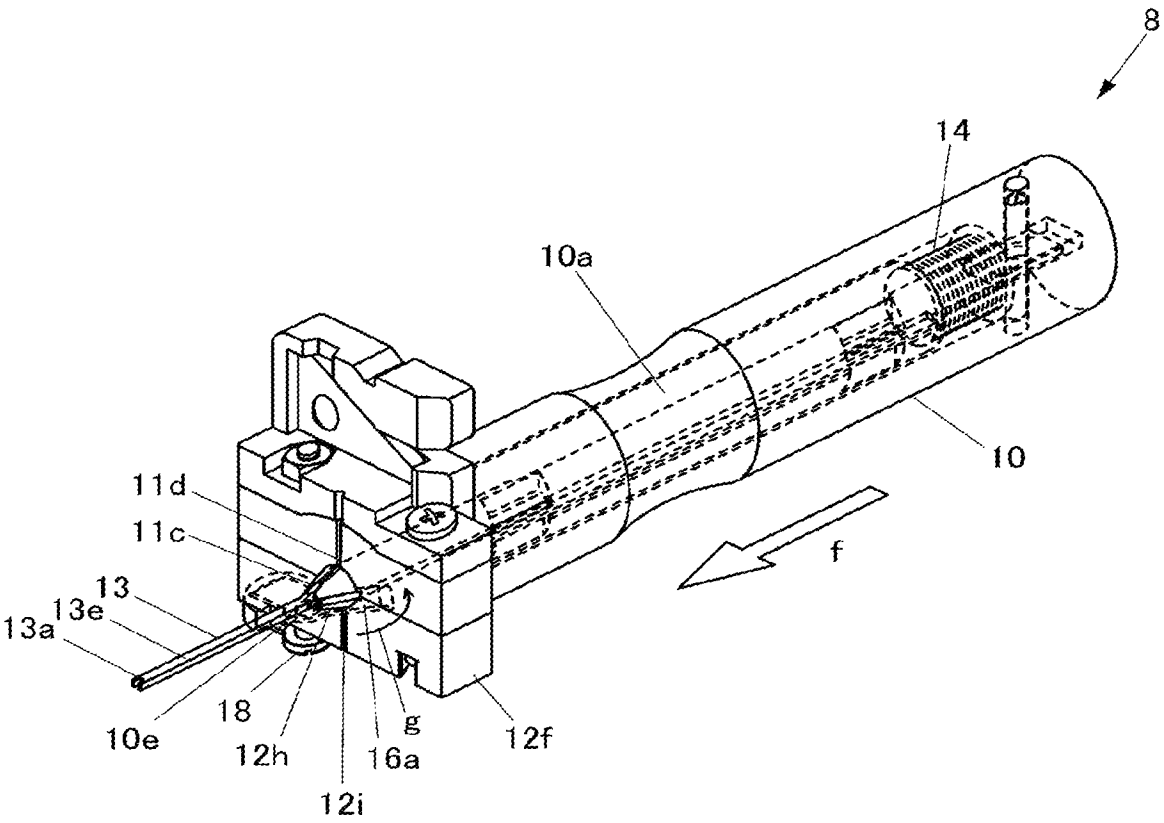
FIG. 5 is a diagram showing the holder 10 in a state in which it is pressed in the arrow f direction from the state shown in FIG. 4.

FIG. 5 is a diagram showing the holder 10 in a state in which it is pressed in the arrow f direction from the state shown in FIG. 4. In this state, the holder 10 and the guide pin 13 are set to the operating position. That is to say, this state corresponds to a state in which a thread is inserted into a thread inserting hole.

When the holder 10 is pressed in the arrow f direction as shown in FIG. 5, the holder spring 14 is compressed between the bottom face of the cylindrical hole 10*b* of the holder 10 and the rear ends of the first main body 11 and the second main body 12. Furthermore, the guide pin 13 fixed to the holder 10 protrudes together with the holder 10 toward the tip-end side, which protrudes the thread capture portion 13*a* from the tip-end portions 11*c* and 12*h* of the first main body 11 and the second main body 12.

In use, the thread is stretched beforehand across the slits 11*d* and 12*i* of the tip-end portions 11*c* and 12*h*. In this state, the thread is captured and extruded by the U-shaped thread capture portion 13*a* of the guide pin 13. In this stage, the arm portion 16*a* of the thread holding spring 16 is turned via the strike plate 17 in the arrow direction g shown in FIG. 5. As a result, the thread 6 on the thread reel side 6*b* is released from being held.

Figure 6:
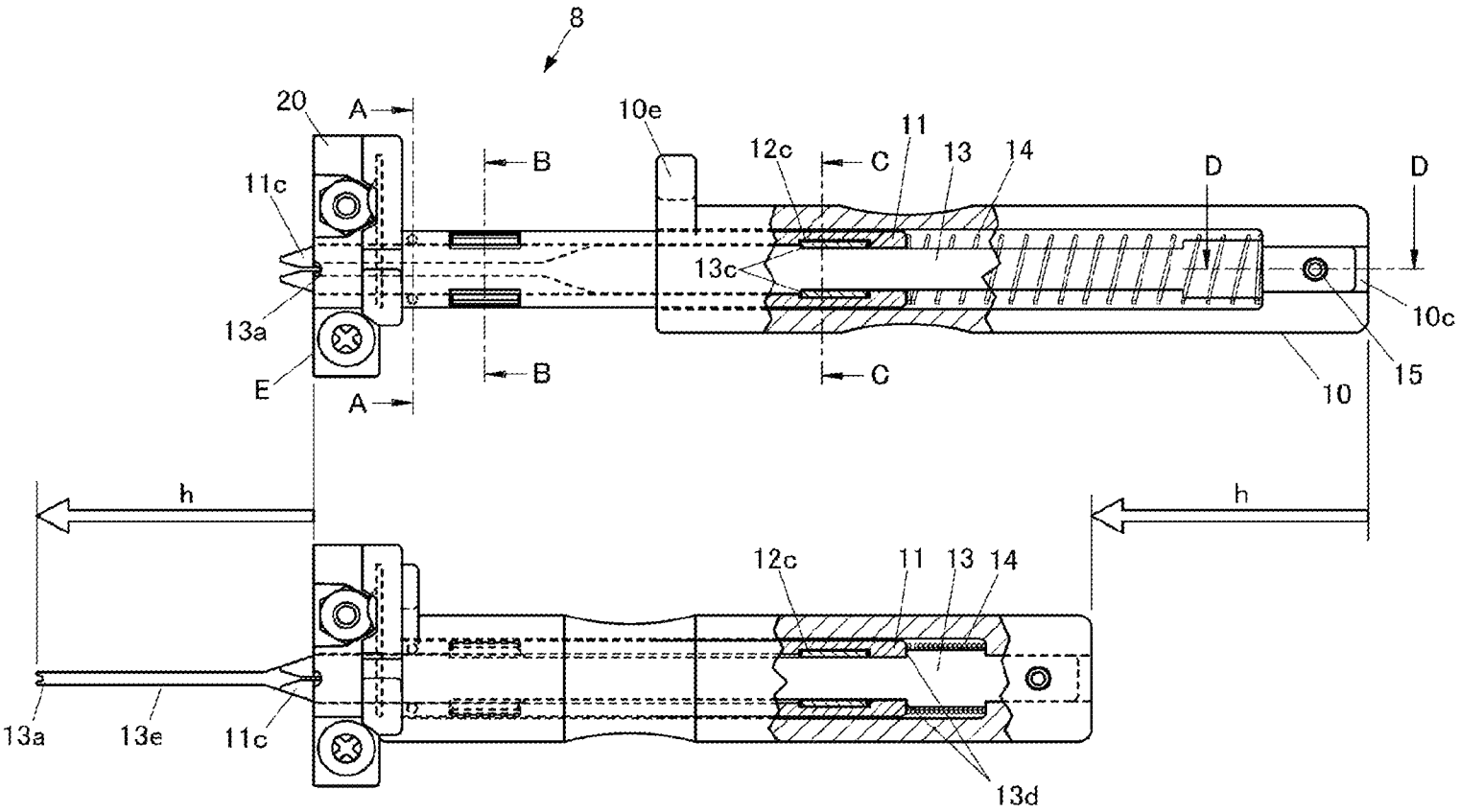
FIG. 6 is a diagram showing a comparison between a state in which the holder 10 and the guide pin 13 are set to the standby position and a state in which the holder 10 and the guide pin 13 are set to the operating position (thread extruding position).

FIG. 6 is a diagram showing a comparison between a state in which the holder 10 and the guide pin 13 are set to the standby position and a state in which the holder 10 and the guide pin 13 are set to the operating position (thread extruding position). In the upper part of FIG. 6, a state is shown in which the holder 10 and the guide pin 13 are set to the standby position. In the lower part of FIG. 6, a state is shown in which the holder 10 and the guide pin 13 are set to the operating position. It should be noted that, in FIG. 6, a part of the configuration is shown in a cross-sectional view.

Figure 7:
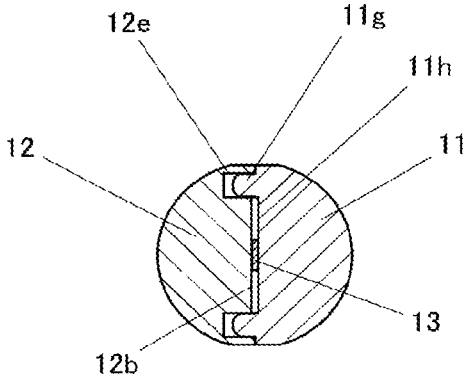
FIG. 7 is a cross-sectional view taken along the line indicated by the arrows A in FIG. 6.

FIG. 7 is a cross-sectional view taken along the line indicated by the arrows A in FIG. 6.

Figure 8:
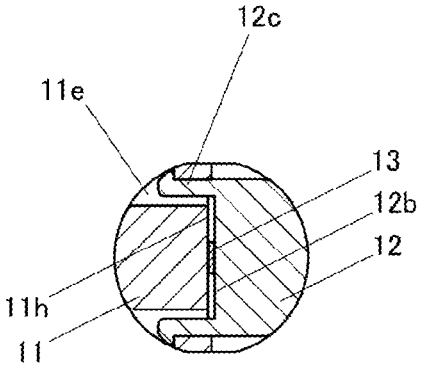
FIG. 8 is a cross-sectional view taken along the line indicated by the arrows B in FIG. 6.

FIG. 8 is a cross-sectional view taken along the line indicated by the arrows B in FIG. 6.

Figure 9:
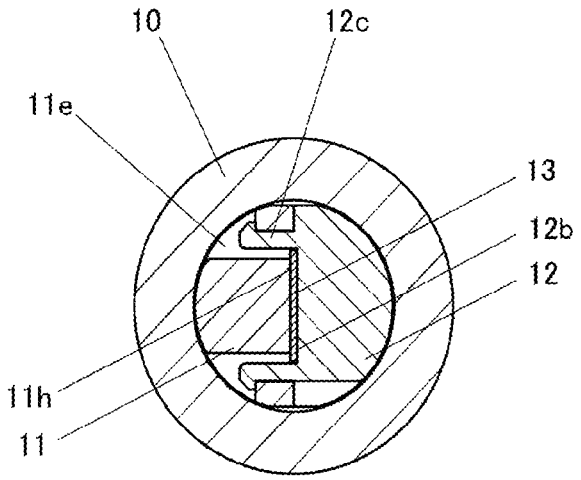
FIG. 9 is a cross-sectional view taken along the line indicated by the arrows C in FIG. 6.

FIG. 9 is a cross-sectional view taken along the line indicated by the arrows C in FIG. 6.

Figure 10:
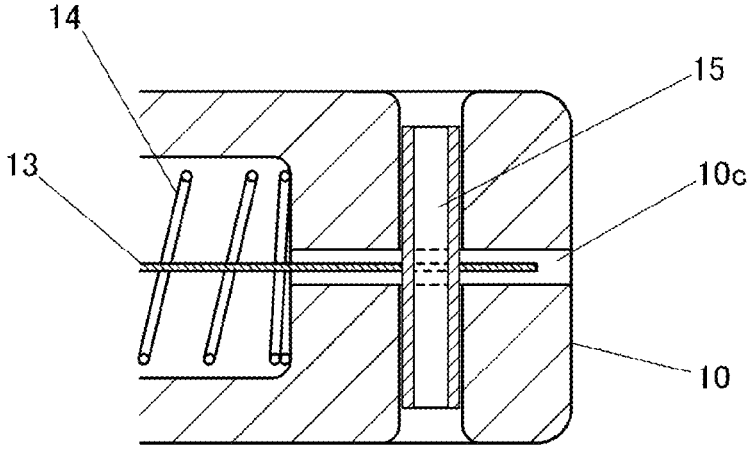
FIG. 10 is a cross-sectional view taken along the line indicated by the arrows D in FIG. 6.

FIG. 10 is a cross-sectional view taken along the line indicated by the arrows D in FIG. 6.

In a state in which the holder 10 and the guide pin 13 are set to the standby position, the holder spring 14 applies a force to the holder 10 and the guide pin 13 in the right-hand direction (toward the rear-end side) in FIG. 6. In this state, the stopper step portion 13*c* of the guide pin 13 comes in contact with the hook 12*c* of the second main body 12, thereby holding the holder 10 and the guide pin 13 at the standby position. In this state, the tip-end position of the thread capture portion 13*a* of the guide pin 13 matches the tip-end face (contact portion) E shown in FIG. 6. It should be noted that the tip-end position of the thread capture portion 13*a* may be changed as appropriate according to the usage.

The tip-end face (contact portion) E is defined as the periphery of the tip-end portions 11*c* and 12*h*. In the thread inserting step, the tip-end face E is set such that it comes in contact with the periphery of the upper looper thread inserting hole 4 or otherwise the lower looper thread inserting hole 5 (description will be made below with such a looper thread inserting hole into which a thread is to be inserted by means of the thread inserting device 8 as a thread inserting hole 22).

FIG. 7 is a cross-sectional view showing a state in which the small protrusions 11*g* of the first main body 11 are fitted to the small holes 12*e* of the second main body 12. The small protrusions 11*g* and the small holes 12*e* function as a reference position that determines the positioning of the first main body 11 and the second main body 12 when they are combined.

FIGS. 8 and 9 are cross-sectional views each showing a state in which each rectangular opening 11*e* of the first main body 11 is engaged with the corresponding hook 12*c* of the second main body 12. As shown in the drawings, each rectangular opening 11*e* of the first main body 11 is engaged with the corresponding hook 12*c* of the second main body 12, thereby fixedly combining the first main body 11 and the second main body 12.

Furthermore, as shown in FIGS. 7 through 9, a space is defined by the grooves 11*h* and 12*b* between the first main body 11 and the second main body 12. The guide pin 13 is held such that it can be slid along such a space defined at a central position.

As shown in the cross-sectional view in FIG. 10, the pin 15 is press-fitted in a state in which the rear-end portion of the guide pin 13 is inserted into the slit 10*c* of the rear-end portion of the holder 10. With such an arrangement, the guide pin 13 is fixedly mounted on the holder 10.

In a state in which the holder 10 and the guide pin 13 are set to the operating position (the lower part of FIG. 6), the holder 10 is pressed in the arrow direction to a length h from a state in which the holder 10 and the guide pin 13 are set to the standby position (see upper view in FIG. 6).

As described above, when the holder 10 is pressed so as to compress the holder spring 14, the holder 10 and the guide pin 13 are shifted toward the operating position side. Eventually, the stopper step portion 13*d* of the guide pin 13 comes in contact with the rear-end faces of the first main body 11 and the second main body 12, which allows the holder 10 to stop before the displacement of the holder 10 exceeds a predetermined length (length h in this example).

This allows the thread capture portion 13*a* of the guide pin 13 to protrude from the tip-end portions 11*c* and 12*h*. The guide pin 13 is fixed to the holder 10 so as to form a single unit. Accordingly, the protrusion length of the guide pin 13 is equal to the displacement (length h in this example) of the holder 10. With such an arrangement, the thread capture portion 13*a* of the guide pin 13 protrudes to a length h from the tip-end face E.

Next, description will be made regarding the operation of the thread inserting device 8 according to the present embodiment.

It should be noted that, for ease of understanding, in the following description, when the holder 10 and the guide pin 13 are set to the standby position, the state of the thread inserting device 8 is also defined as the standby state.

Figure 11:
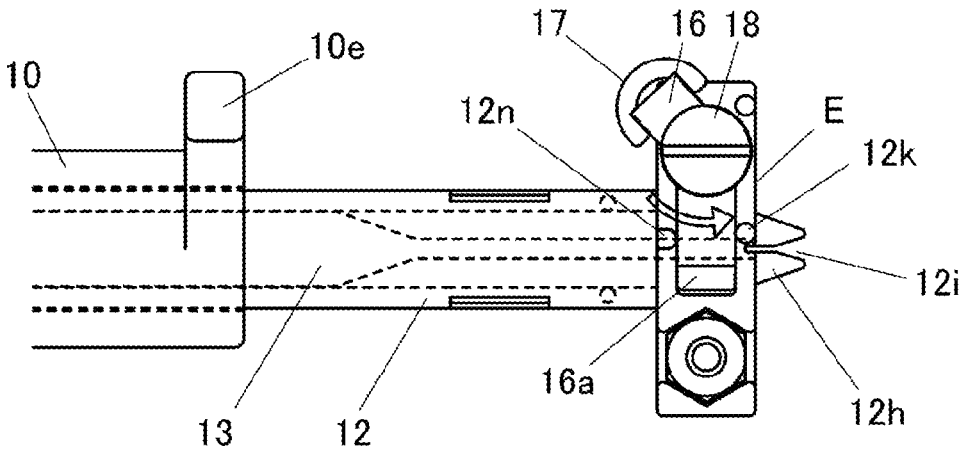
FIG. 11 is a diagram showing the thread inserting device 8 in the standby state.

FIG. 11 is a diagram showing the thread inserting device 8 in the standby state.

In the state shown in FIG. 11, the operator manually turns the thread holding spring 16 in the counterclockwise direction shown in FIG. 11 with the shoulder screw 18 as the center of rotation until the arm portion 16*a* comes in contact with a small protrusion 12*k* formed in the second main body 12. In this state, by supplying a thread to the slit 12*i* from the lower side of the arm portion 16*a* of the thread holding spring 16 via a recess 12*n* formed in the second main body 12, such an arrangement allows the thread to be held by the thread holding spring 16. This limits the movement of the thread, i.e., prevents an undesired movement of the thread.

Figure 12:
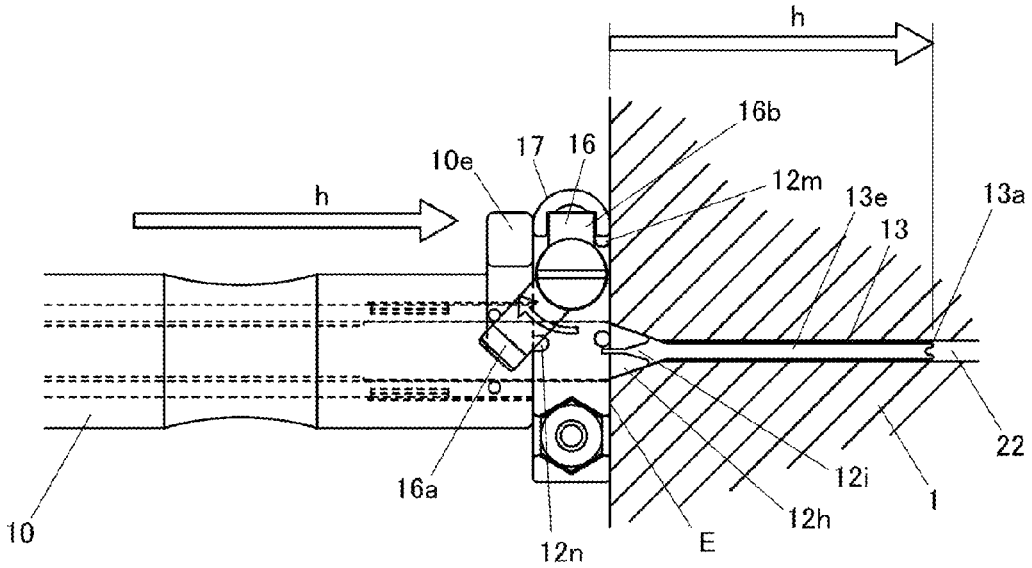
FIG. 12 is a diagram showing a state in which the first main body 11 and the second main body 12 are pressed in contact with the thread inserting unit 1 from the standby state shown in FIG. 11, and accordingly, the holder 10 is pressed and shifted by the length h toward the right side (tip-end side) in the drawing.

FIG. 12 is a diagram showing a state in which the first main body 11 and the second main body 12 are pressed in contact with the thread inserting unit 1 from the standby state shown in FIG. 11, and accordingly, the holder 10 is pressed and shifted to the length h toward the right side (tip-end side) in the drawing.

In this state, the tip-end protrusion 10*e* of the holder 10 presses and shifts the strike plate 17 that is fitted to the thread holding spring 16 such that they engage with each other. As a result, the thread holding spring 16 is turned in the clockwise direction shown in FIG. 12 with the shoulder screw 18 as the center of rotation. Eventually, the arm portion 16*b* comes in contact with a small protrusion 12*m* formed in the second main body 12, thereby stopping the thread holding spring 16.

In this stage, the arm portion 16*a* retracts up to the recess 12*n* formed in the second main body 12. In this state, the thread held in the state shown in FIG. 11 is released. That is to say, the limit placed on the movement of the thread is removed. The thread capture portion 13*a* of the guide pin 13 is inserted to the length h into the thread inserting hole of the thread inserting unit 1. That is to say, by supplying a thread to the slit 12*i*, such an arrangement allows the guide pin 13 to insert the thread to the length h into the thread inserting hole 22.

Next, description will be made regarding a procedure for inserting the thread 6 into the thread inserting hole 22 of the thread inserting unit 1 using the thread inserting device 8.

Figure 13:
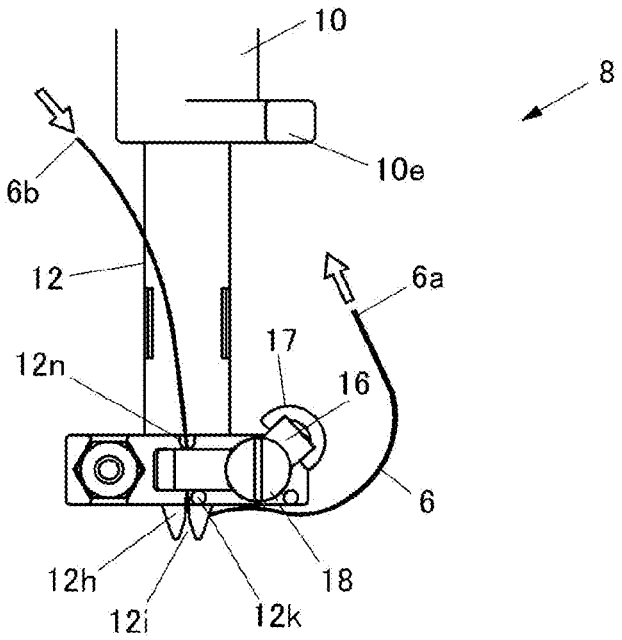
FIG. 13 is a diagram showing the thread inserting device 8 in the standby state in which the thread 6 is set before the thread is inserted.

FIG. 13 is a diagram showing the thread inserting device 8 in the standby state in which the thread 6 is set before the thread is inserted.

In the state shown in FIG. 13, after the thread 6 is held by the thread holding spring 16, the thread 6 is drawn toward the rear-end side (the upper side shown in FIG. 13) via the slit 12*i*.

Figure 14:
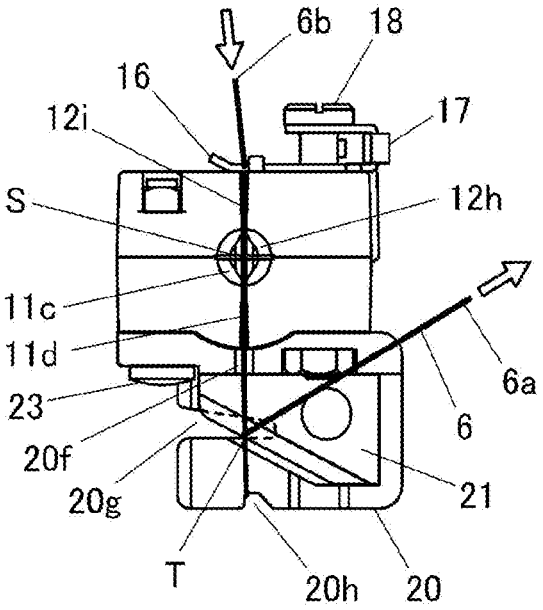
FIG. 14 is a diagram showing the state shown in FIG. 13 as viewed from the tip-end side of the thread inserting device 8.

FIG. 14 is a diagram showing the state shown in FIG. 13 as viewed from the tip-end side of the thread inserting device 8.

Figure 15:
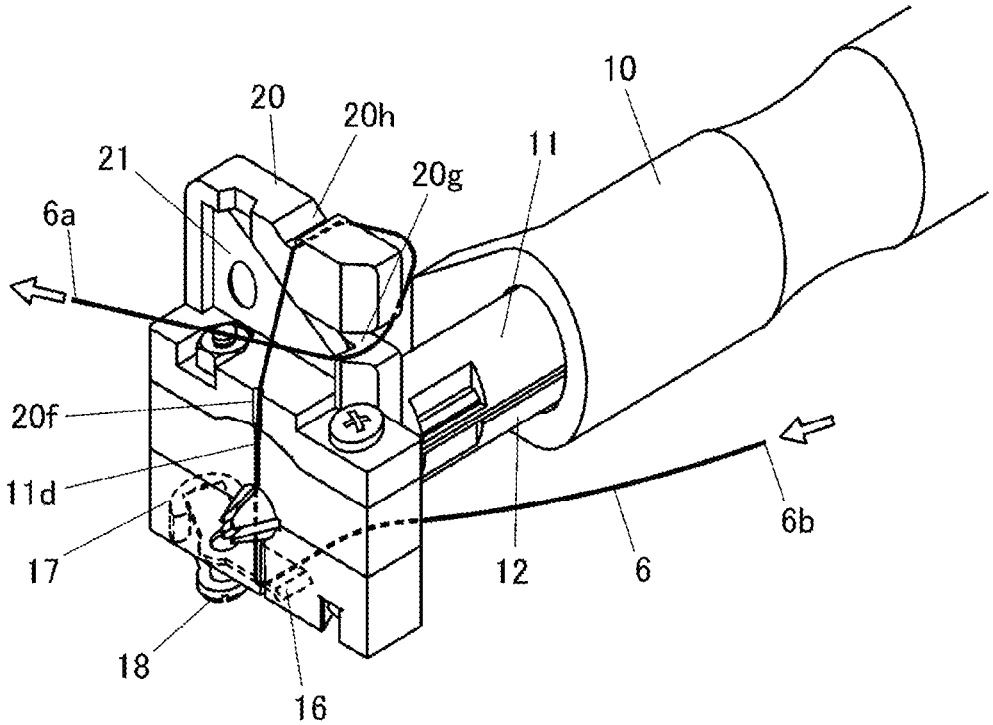
FIG. 15 is a diagram showing a path along which the thread 6 is drawn.

FIG. 15 is a diagram showing a path along which the thread 6 is drawn.

As shown in FIG. 14, after the thread 6 is drawn such that it passes through the slit 12*i*, the thread 6 is further drawn to the guide groove 20*g* via the slit 11*d*, the thread groove 20*f* formed in the thread cutting base 20, and the thread hook 20*h*, in this order.

After the thread. 6 is supplied to the guide groove 20*g*, the thread 6 is further shifted toward the bottom of the guide groove 20*g*. Eventually, the thread 6 is guided to the blade portion 21*b* of the thread cutting blade 21 and the thread 6 is cut. The path along which the thread 6 is to be drawn is designed such that the thread 6 drawn from the thread capture portion 13*a* up to the thread cutting position has a predetermined length k (described later).

Figure 16:
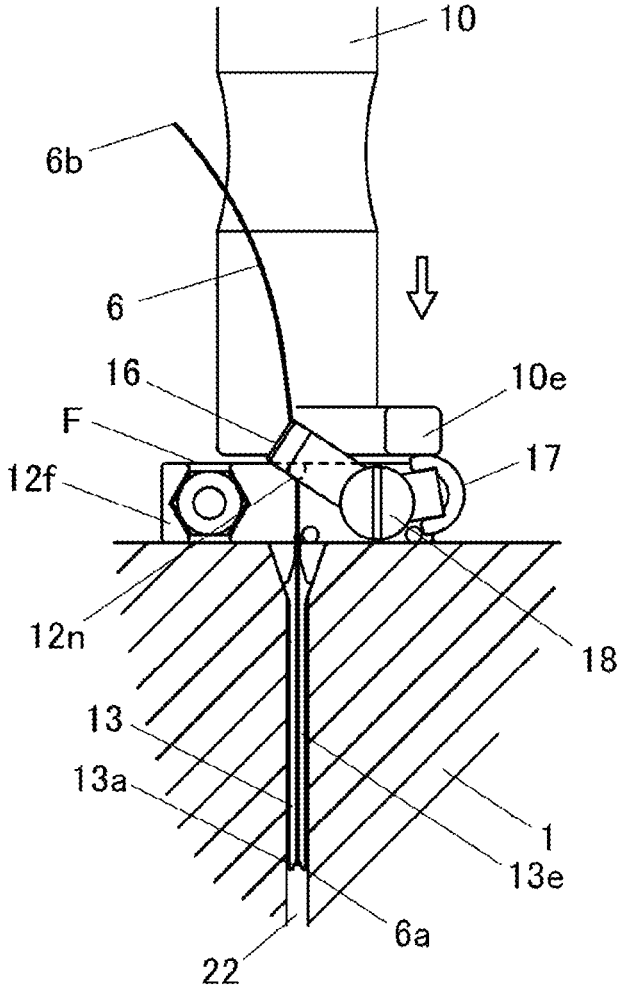
FIG. 16 is an intermediate state in which the tip-end protrusion 10*e* of the holder 10 presses the strike plate 17.

FIG. 16 is an intermediate state in which the tip-end protrusion 10*e* of the holder 10 presses the strike plate 17.

As shown in FIG. 16, the thread 6 is held by the thread holding spring 16 until immediately before the tip-end protrusion 10*e* reaches a face F of the rectangular portion 12*f*. Moreover, the thread tip 6*a* is pressed and inserted into the thread inserting hole 22 by means of the guide pin 13.

Figure 17:
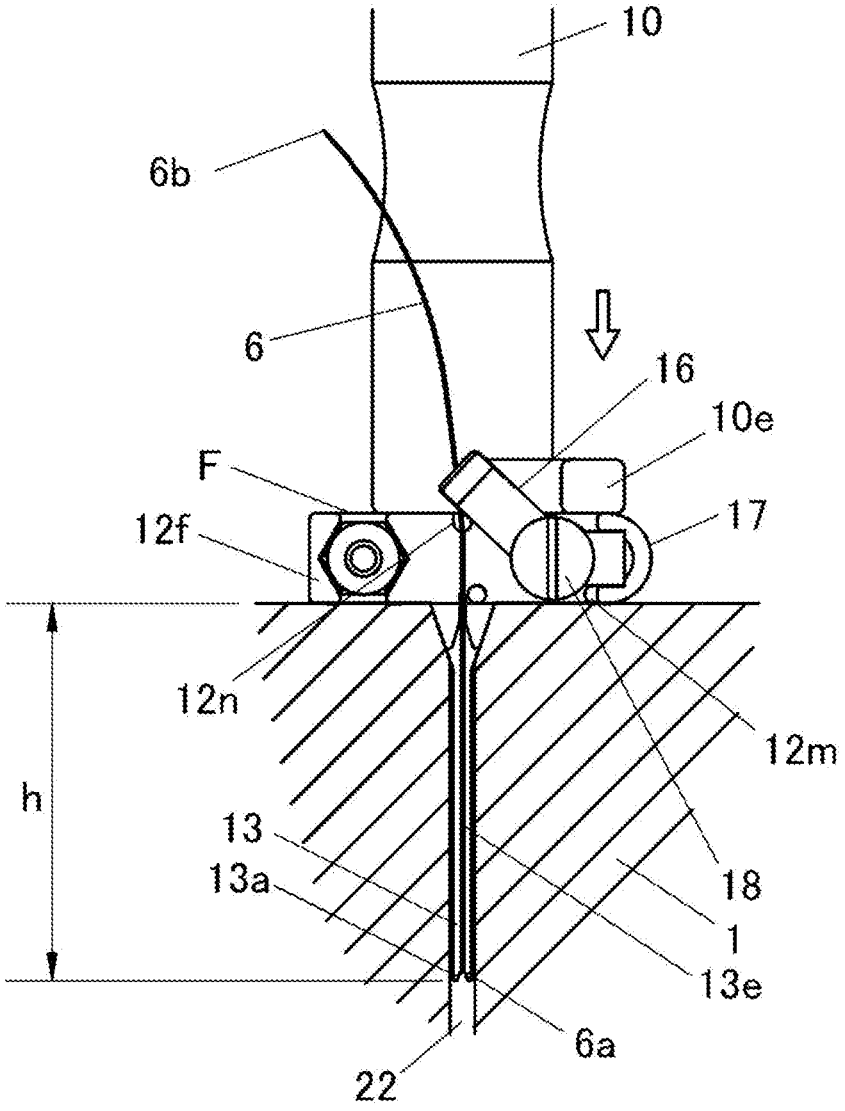
FIG. 17 is a diagram showing a state in which the tip-end protrusion 10*e* of the holder 10 reaches the face F of the rectangular portion 12*f* after it is pressed.

FIG. 17 is a diagram showing a state in which the tip-end protrusion 10*e* of the holder 10 reaches the face F of the rectangular portion 12*f* after it is pressed.

When the state shown in FIG. 17 is obtained after the holder 10 is pressed, the thread holding spring 16 is shifted away from the recess 12*n* of the second main body 12, thereby releasing the thread 6 from being held.

Figure 18:
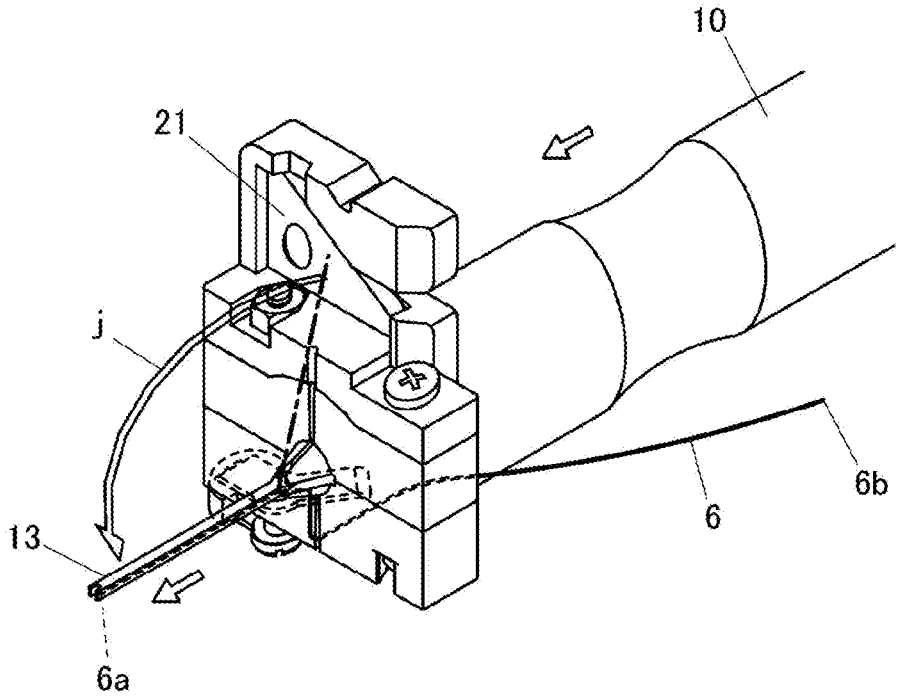
FIG. 18 is a diagram showing an outline of the behavior of the thread 6 after it is cut by means of the thread cutting blade 21.

FIG. 18 is a diagram showing an outline of the behavior of the thread 6 after it is cut by means of the thread cutting blade 21.

As indicated by the arrow j in FIG. 18, after the thread 6 is cut by means of the thread cutting blade 21, the thread tip 6*a* of the thread 6 is drawn by means of the guide pin 13 and inserted into the thread inserting hole 22.

It should be noted that, in the state shown in FIGS. 13 and 16, the thread 6 is held by the thread holding spring 16 so as to limit its movement. In contrast, in the state shown in FIG. 17, the thread holding spring 16 is shifted such that it retracts from the recess 12*n*, thereby releasing the thread 6 from being held. That is to say, in a step in which the holder 10 is pressed such that the thread 6 is inserted into the thread inserting hole 22 by means of the guide pin 13, the thread 6 is controlled such that the thread tip 6*a* side is supplied and inserted into the thread inserting hole 22, and such that the thread reel side 6*b* is not supplied to the thread inserting hole 22. As described above, the thread 6 is controlled such that only the cut end side of the thread 6, which is the side cut by the thread cutting blade 21, is inserted into the thread inserting hole 22. This allows the thread 6 to be inserted into the thread inserting hole 22 to a predetermined length in a stable manner.

Description will be made below regarding the reason why the thread 6 on the thread reel side 6*b* is released from being held in the state shown in FIG. 17 in which the holder 10 is pressed until the conclusion of this step.

After the insertion of the thread 6 ends in the state shown in FIG. 17, the flow proceeds to a next step in which the thread inserting device 8 is again extracted from the thread inserting hole 22. In this step, if the thread 6 continues to be held, the thread 6 thus inserted is extracted together with the thread inserting device 8. In order to solve such a problem, in the state shown in FIG. 17 in which the holder 10 is pressed until the conclusion of the step, the thread 6 is released from being held, thereby allowing only the thread inserting device 8 to be extracted.

In the present embodiment, as shown in FIG. 17, the guide pin 13 can be protruded to the length h. With the length of the thread 6 from the center of the thread inserting device 8 shown in FIG. 14 (i.e., the center of the guide pin 13, and specifically, the position of the thread capture portion 13*a*) S up to the thread end T cut by the thread cutting blade 21 as k, the magnitude relation between the length h and the thread length k can be set to one from among the following three relations.

(A) Configuration designed such that the relation k>h holds true: The thread end T is inserted into the thread inserting hole 22 up to the depth h in a state in which it is folded back by a difference between k and h.

(B) Configuration designed such that the relation k=h holds true: The thread end T is inserted into the thread inserting hole 22 up to the depth h.

(C) Configuration designed such that the relation k<h holds true: The thread end T is inserted into the thread inserting hole 22 up to the depth k.

The designer may set such a magnitude relation between k and h as desired according to respective designs. However, the relation (C) is most preferably employed. Description will be made below regarding the reason.

In a case of employing the relation (A), a part of the thread 6 is folded back in the thread inserting hole 22. Accordingly, a thread loop occurs in the vicinity of the thread end T. In this case, in a transfer step in which the thread is transferred via a pipe by means of air pressure, such a loop has the potential to function as friction. In some cases, such an arrangement leads to difficulty in smoothly transferring a thread.

In a case of employing the relation (B), such an arrangement operates normally in theory. Thus, such an arrangement is preferably designed as compared with that in a case of employing the relation (A). However, in practice, the magnitude relation between k and h fluctuates due to the precision of the respective parts, variation in pressing force applied to the holder 10, and the like. Therefore, in some cases, it becomes the relation (A), or becomes the relation (C). Thus, the relation (C) is more preferably employed.

In a case of employing the relation (C), such a configuration is designed such that the aforementioned length k matches a predetermined length of a thread to be inserted into the thread inserting hole as necessary according to a sewing machine to be used. In addition, the guide pin 13 is designed such that the protrusion length h is greater than the aforementioned length k. Such an arrangement provides a stable operation while the magnitude relation between k and h is prevented from becoming the relation (A) or otherwise the relation (B). Thus, the relation (B) is preferably employed as compared with the relation (A). Furthermore, the relation (C) is more preferably employed.

As described above, in the present embodiment, the guide pin 13 is arranged within a space defined between the first main body 11 and the second main body 12. By operating the holder 10, such an arrangement allows the guide pin 13 to protrude. Such an arrangement only requires the operation of the holder 10 to insert the thread 6 into the thread inserting hole 22 together with the guide pin 13. Furthermore, such an arrangement allows the thread 6 to be cut to a predetermined length in a simple manner. In addition, the movement of the thread 6 is limited by the thread holding spring 16. The limit placed on the thread movement is automatically released at the timing when the thread insertion is completed. Thus, with the present embodiment, for such a thread inserting operation for the air-pressure threading apparatus, which is difficult in a case of employing conventional techniques, such an arrangement allows the operation to be performed in a stable and sure manner regardless of the skill level of the operator.

Moreover, the main body is configured as a combination of two separate members, i.e., the first main body 11 and the second main body 12. With such an arrangement, the first main body 11 and the second main body 12 are combined such that the guide pin 13 is interposed between them. Furthermore, such a structure thus assembled is inserted into the cylindrical hole 10*b* of the holder 10. This allows the overall configuration to have a compact size. With such a configuration, the members of such a structure operate in combination with each other so as to provide improved strength. This provides such a compact-size configuration with sufficient strength.

Furthermore, by setting the aforementioned length k to be smaller than the length h, such an arrangement provides improved stability in the thread inserting operation.

Second Embodiment

Figure 19:
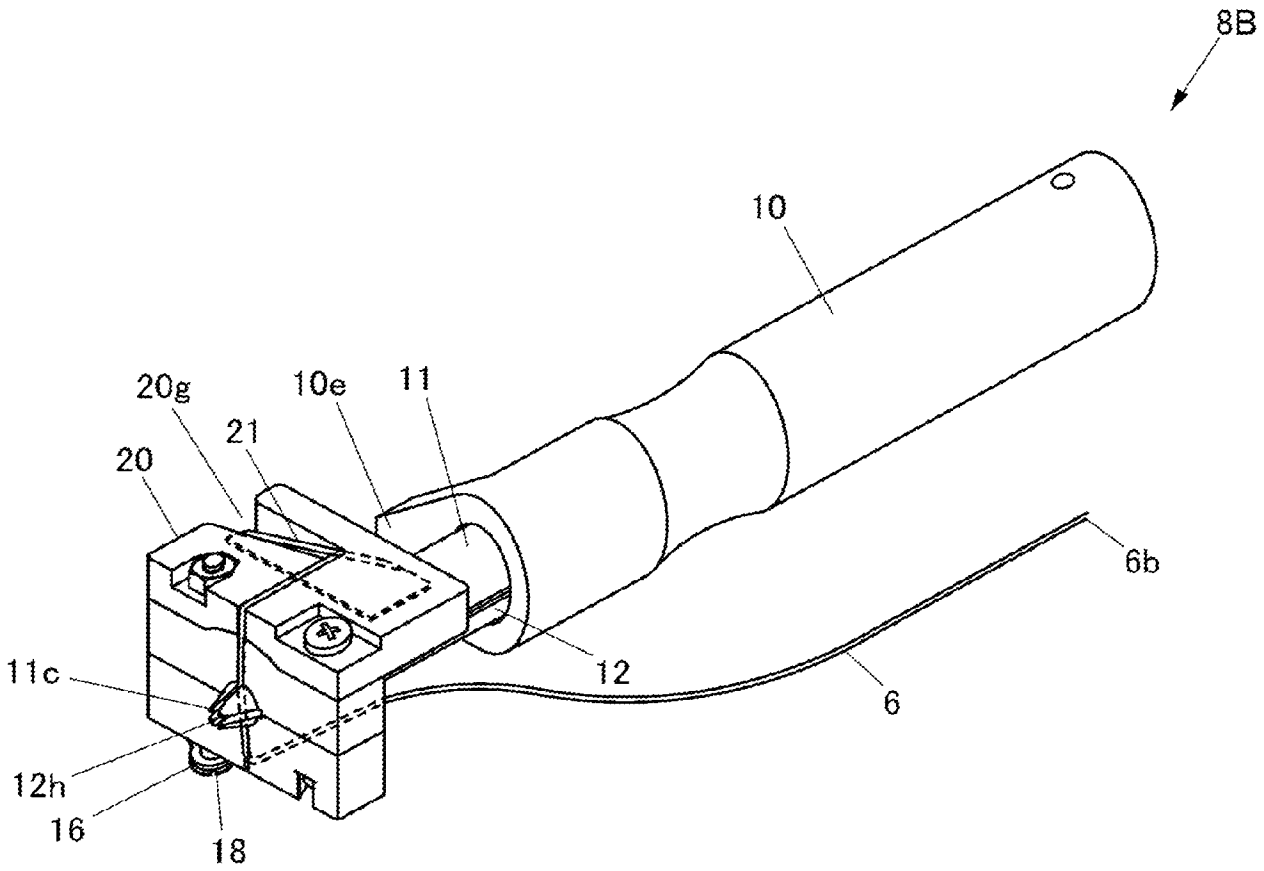
FIG. 19 is a perspective view showing a thread inserting device 8B according to a second embodiment.
Figure 20:
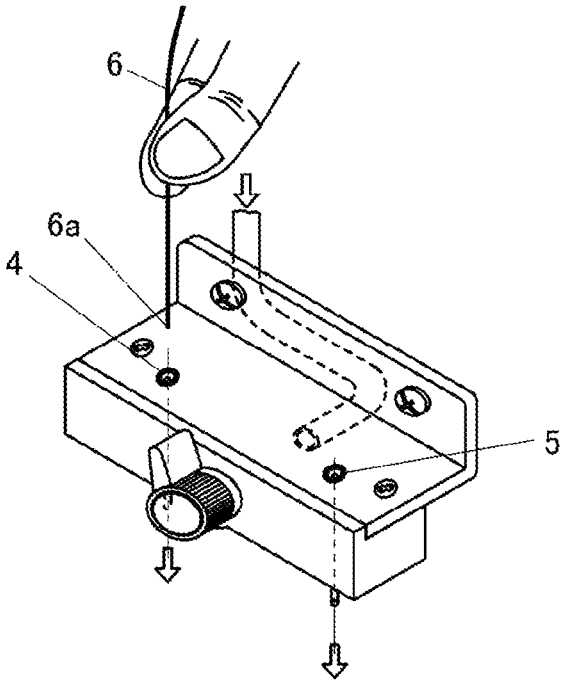
Prior Art Fig.20
FIG. 20 is a diagram showing a step according to conventional techniques in which a thread is inserted into a thread inserting hole with the fingers.

FIG. 19 is a perspective view showing a thread inserting device 8B according to a second embodiment.

The second embodiment has the same configuration as that in the first embodiment except for the orientation of the mounting of the thread cutting blade 21.

As described above, by changing the orientation of the mounting of the thread cutting blade 21, such an arrangement allows the thread inserting device 85 to be designed as an easy-to-use device according to the sewing machine to be used.

[Modification]

The present invention is not restricted to the embodiments described above. Rather, various changes and modifications may be made, which are encompassed within the technical scope of the present invention.

For example, description has been made in the embodiments regarding an example in which the guide pin 13 is configured as a plate-shaped member. However, the present invention is not restricted to such an arrangement. For example, the guide pin may be configured as a shaft-shaped member.

Description has been made in the embodiments regarding an arrangement in which the main body is configured as a combination of the first main body 11 and the second main body 12. However, the present invention is not restricted to such an arrangement. For example, the main body may be configured as a single member. Also, the main body may be configured as a combination of three or more members.

It should be noted that the embodiments and modifications may be mutually combined. However, detailed description thereof will be omitted. Also, the present invention is by no means restricted by the embodiments described above.

REFERENCE SIGNS LIST

1 thread inserting unit, 2 tube, 3 selection knob, 4 upper looper thread inserting hole, 5 lower looper thread inserting hole, 6 thread, 6*a* thread tip, 6*b* thread reel side, 8, 8B thread inserting device, 8*a* conical protrusion slit, 8*c* back face, 10 holder, 10*a* recess, 10*b* cylindrical hole, 10*c* slit, 10*d* round through hole, 10*e* tip-end protrusion, 11 first main body, 11*a* main body portion, 11*b* rectangular portion, 11*c* tip-end portion, 11*d* slit, 11*e* rectangular opening, 11*f* round hole, 11*g* small protrusion, 11*h* groove, 12 second main body, 12*a* main body portion, 12*b* groove, 12*c* hook, 12*d* joint face, 12*e* small hole, 12*f* rectangular portion, 12*g* through hole, 12*h* tip-end portion, 12*i* slit, 12*j* recess, 12*k* small protrusion, 12M small protrusion, 12*n* recess, 13 guide pin, 13*a* thread capture portion, 13*b* round opening, 13*c* stopper step portion, 13*d* stopper step portion, 13*e* thread capture shaft portion, 14 holder spring, 15 pin, 16 thread holding spring, 16*a* arm portion, 16*b* arm portion, 17 strike plate, 18 shoulder screw, 19*a*, 19*b* nut, 20 thread cutting base, 20*a* mounting portion, 20*b* fixing protrusion, 20*c* through hole, 20*d* recess, 20*e* through hole, 20*f* thread groove, 20*g* guide groove, 20*h* thread hook, 21 thread cutting blade, 21*a* round opening, 21*b* blade portion, 22 thread inserting hole, 23 screw.

What is claimed is:

1. A thread inserting device for inserting a thread into a thread inserting hole of a sewing machine, the thread inserting device comprising:

a guide member having a thread capture portion at a tip end thereof configured to capture a thread;

a holder that fixedly holds the guide member;

a main body slidably mounting the holder; and a thread cutting portion that is provided to the main body, and is configured to cut a thread to a length that is equal to or otherwise smaller than a length of a protrusion of the thread capture portion from a position at which the thread is captured by the thread capture portion on a thread tip side after the thread is captured by the thread capture portion, wherein, by shifting the holder, the thread capture portion is protruded to a predetermined length from the main body, so as to insert the thread cut to a predetermined length by the thread cutting portion into the thread inserting hole.

2. A thread inserting device for inserting a thread into a thread inserting hole of a sewing machine, the thread inserting device comprising:

a guide member having a thread capture portion at a tip end thereof configured to capture a thread;

a holder that fixedly holds the guide member;

a main body mounting the holder and the guide member such that they can be slidably shifted between an operating position at which the thread capture portion is protruded and a standby position at which the thread capture portion is retracted;

a thread holding portion that is provided to the main body and that is configured to hold a thread on a thread reel side after the thread is captured by the thread capture portion when the holder is set to the standby position; and a thread cutting portion that is provided to the main body, and that is configured to cut a thread to a length that is equal to or otherwise smaller than a length of a protrusion of the thread capture portion from a position at which the thread is captured by the thread capture portion on a thread tip side after the thread is captured by the thread capture portion, wherein, by shifting the holder to the operating position, the thread capture portion is protruded to a predetermined length from the main body, so as to insert the thread cut to a predetermined length by the thread cutting portion into the thread inserting hole.

3. The thread inserting device according to claim 2, further comprising a releasing portion that releases the thread from being held by the thread holding portion, by shifting the holder from the standby position to the operating position side.

4. The thread inserting device according to claim 2, wherein the main body comprises a first main body and a second main body, wherein the first main body and the second main body are arranged such that the guide member is interposed between them, wherein the holder has a hole through which the main body and the guide member are inserted, and wherein the main body is inserted together with the guide member into the hole of the holder.

5. The thread inserting device according to claim 2, further comprising a force applying portion that applies, to the holder, a force toward the standby position.

6. The thread inserting device according to claim 5, wherein the main body comprises:

a protruding portion configured to be inserted into the thread inserting hole of the sewing machine; and a contact portion that is provided as a periphery of the protruding portion, and that comes in contact with a periphery of the thread inserting hole so as to maintain a position of the main body when the holder is shifted toward the operating position side against the force applied by the force applying portion.

* * * * *